US005735170A

United States Patent [19]

Bales et al.

[11] Patent Number: 5,735,170

[45] Date of Patent: Apr. 7, 1998

[54] PUMPING UNIT WITH DYNAMIC FLUID BALLAST

[76] Inventors: Donald R. Bales, Avenue C and Cedar, P.O. Box 936, Denver City, Tex. 79323; Darryl L. Bales, 2811 43rd St., Apt. 9, Lubbock, Tex. 79413; Clifford B. Fedler, 7913 Joliet Ave., Lubbock, Tex. 79423

[21] Appl. No.: 526,853

[22] Filed: Sep. 11, 1995

[51] Int. Cl.[6] ..... F16H 21/32

[52] U.S. Cl. ..... 74/41; 74/108

[58] Field of Search ..... 74/40, 41, 108

[56] References Cited

U.S. PATENT DOCUMENTS

| | | | |
|---|---|---|---|
| 420,692 | 2/1890 | Miller | 74/41 |
| 2,370,029 | 2/1945 | Gillespie . | |
| 3,248,958 | 5/1966 | Bender . | |
| 3,868,820 | 3/1975 | Lawson . | |
| 4,179,947 | 12/1979 | James . | |
| 4,197,766 | 4/1980 | James . | |
| 4,391,155 | 7/1983 | Bender . | |
| 4,404,863 | 9/1983 | James . | |
| 4,456,060 | 6/1984 | Stanton . | |
| 4,483,208 | 11/1984 | Parker, Jr. | 74/41 |
| 4,496,285 | 1/1985 | Albert et al. . | |
| 4,534,706 | 8/1985 | Palm et al. . | |
| 4,676,311 | 6/1987 | Dysarz . | |
| 4,761,120 | 8/1988 | Mayer et al. | 417/403 |

*Primary Examiner*—Allan D. Herrmann
*Attorney, Agent, or Firm*—Henry Croskell, Esq.

[57] ABSTRACT

A pumping unit apparatus is provided for operating a well pump having sucker rod drive which is reciprocated from an uppermost position to a lowermost position, the apparatus having a base, a support structure mounted on the base, a member mounted on the support structure for pivotal movement about an axis and means connected to the member for pivoting said member between the two positions. Belting and pulley combinations mounted on the member and connected to the sucker rod provides rod string positioning to the rod string uppermost position when the member is on one position and a lower position when the member is in another position; a counterweight mounted on the member for movement with said member is provided wherein the counterweight is positioned relative to the axis so that the force of gravity acting on the counterweight applies a greater torque to the member when the rod string is in its uppermost position than is applied when the rod string is in its lowermost position. The counterweight being so positioned that a vertical line through the center of gravity of the shifting ballast counterweight moves toward and away from said axis as said member is pivoted.

13 Claims, 3 Drawing Sheets

PUMPING UNIT WITH DYNAMIC FLUID BALLAST

BACKGROUND OF THE INVENTION

1. Field of the Invention

The present invention relates to a well pumping unit having adjustable stroke capability and dynamic fluid ballast which shifts ballast weight as the pump passes through a complete stroke cycle. In another aspect, the pumping unit with dynamic fluid ballast provides for balancing of loads on the pump power source while avoiding large shock loading upon sucker rods and pumping unit as the sucker rods reverse motion at the end of each upward and downward stroke.

2. Description of the Prior Art

Early development of petroleum fields for production purposes frequently utilizes reservoir pressure alone to lift the oil to the surface. However, such pressure is eventually exhausted whereupon the oil must be pumped to the surface. In more modern times, depletion of aquifers have also created deep well pumping requirements for producing irrigation water and water for public consumption. The most common variety of pumping unit in use is a walking beam pumping unit having a nominal stroke of approximately seven to twelve feet. The walking beam pumping unit is suitable for shallow, medium and deep wells; but, such a pumping unit becomes increasingly energy inefficient and expensive as well depth and stroke frequency increases.

The walking beam pumping unit presents a beam pivotally mounted on the base and an electric or internal combustion engine which, through a large speed reducer, drives a linkage connected to one end of the beam for rocking the beam on the base about a generally horizontal axis. The other end of the beam is connected by means of a cable, for example, to a polished rod which extends vertically through the well head. A string of sucker rods extends from the polished rod down into the well inside tubing to a plunger type pump valve which is positioned adjacent the oil producing formation. As the beam is rocked on the base, the sucker rods reciprocate up and down in the tubing and oil is pumped up and out of the well casing to storage vessels.

Another version of the walking beam is the "horse head" type pumping unit used for decades to actuate downhole pumps, forcing water or oil to the surface from a subterranean water or oil bearing formation. All the horse head pumping units include a wire line or cable connected to the horse head, passing over a convex outer face curve about the pivotal axis of the walking beam. The cable or wire line lies on the curved outer face of the horse head tangent to the outer face in a vertical position over a well head regardless of the position of the horse head in its stroke. The wire line connects at its lower end to a rod string by wire clamps or connecting devices. The flexible cable or wire line lying on the curved face of the horse head provides for vertical reciprocation of the pump rod as the horse head goes through its stroke, without bending the rod. The rod string is connected to the plunger of the downhole pump providing for fluid pumping action.

Walking beam pumping units have also been modified by counterbalancing arrangements. For example, a counterweighted crank is connected to the prime mover through a gear reducer. The crank, in turn, is connected at the counterweight through a pair of pitman rods to one end of the walking beam. As the counterweight realizes its potential energy and passes from the top to the bottom of its rotation, it assists the prime mover in overcoming the rod string load and fluids being pumped during the work stroke by counterbalancing the load. During the return stroke, the prime mover must raise the counterweight from a bottom position to a top position so that the potential of the counterweights can again be realized during the next work stroke. This is a simple system, but requires a relatively high horsepower rated prime mover to move the counterweight through the rotation cycle.

The loads imposed upon sucker rod of an oil well pump jack are considerable. During the upstroke in a typical oil well, depending on rod diameter, the weight of the sucker rods and the oil being lifted amounts to about 1.6 pounds per foot of well depth, and thus about 8,000 pounds in a 5,000 foot well, it being understood that many oil wells are considerably deeper than 5,000 feet. When a conventional rocker arm oil well pumping unit is in use, very large shock loadings are being placed on the sucker rods as the sucker rod reverses its motion at the end of each upward and downward stroke. These shocks are damaging to the sucker rods as well as components of the pump and pumping unit. These large shock loadings upon the sucker rods arise because of a large difference between the upwardly directed force which is needed to stop the downward stroke of the sucker rods and that necessary to cause the sucker rods to begin its upward stroke. The pumping unit can stop the downward stroke of the sucker rods by imposing on the sucker rods an upwardly directed force about equal to the weight of the sucker rods and plunger. However, during the upward stroke of the sucker rods, not only must the sucker rods and plunger be lifted, but also the column of fluid within the well. Thus, at the beginning of the upward stroke of the sucker rods, the pumping unit must impose upon the sucker rods an upwardly directed force at least about equal to the weight of the sucker rods plunger, and column of fluid in the well. The column of fluid in a 5,000 foot well weighs above 3,000 pounds and, thus, at the beginning of each upward stroke, this weight is instantaneously imposed upon the sucker rods, resulting in a massive shock loading. Similarly, at the beginning of the downward stroke, the sucker rods are instantaneously relieved of this weight resulting in another massive shock loading. In conventional oil well pumping units, no shock absorbing means are provided to cushion the sudden shock loadings upon the sucker rods. Repeated shock loadings upon the sucker rods tend, eventually, to cause fractures thereof leaving a considerable length of broken sucker rods in the well. Fishing the broken rods out through the surrounding tubing involves considerable expense and a lengthy interruption of production from the well. Pumping of the well ore cannot be resumed until the broken sucker rods have been removed and replaced.

In conventional type pumping units for pumping oil, water and other liquids from a well, usually, a counterweight is mounted on the opposed limb of the rocker arm to counter balance the greater part of the weight of the sucker rods and plunger. To pivot the rocker arm and thus to reciprocate the sucker rods vertically, the upper end of a crank is fixed to the rocker arm between the counter weight and the pivot. The lower end of this crank is connected to a rotating arm fixedly mounted on a rotating drive shaft position between the point of attachment of the crank to the rocker arm. The drive shaft is driven via a gear box from conventional motor means, the motor usually being electric or internal combustion. The rotation of the drive shaft causes the sucker rods to reciprocate vertically. The motion of the sucker rods is a substantially simple motion subject to second order deviations due to the displacement of the crank from the vertical during the rotation of the drive shaft. That is, approximately half way through a substroke, the sucker rods are traveling at their maximum velocity and from this point there is applied to the sucker rods an increasingly downward acceleration until the sucker rods finally halt at the end of their upstroke. This same downward acceleration is continued into the first part of the downstroke but decreases until approximately half-way through the downstroke; no acceleration is being applied although the sucker rods are moving downwardly at their maximum velocity. The accelerations imposed on the sucker rods are considerable. Not only do the directional change accelerations through the cycles of the up and down strokes of the sucker rods have a tendency to cause fractures in the sucker rods and the pumping units have a tendency also to break gear box apparatus of the pumping units which also involve considerable expense and lengthy interruption of production of the well.

The area serviced by an oil well usually is in the order of several acres or tens of acres with the oil percolating gradually through the surrounding strata along a multitude of channels toward the well. In order to obtain maximum production from the well, it is desirable that the flow of oil toward the well be as smooth and continuous as possible, and that no sudden pressure surges be allowed to occur within the oil surrounding the well. Such pressure surges tend to interrupt the flow of oil toward the well and to clog the channels through which oil must move.

Sudden reversals of sucker rod motion produced by conventional oil well pumping units produce precisely such pressure surges within the well. For example, at the beginning of the upward stroke, the large acceleration imposed upon the sucker rods and plunger causes an extremely abrupt rise in pressure within the pump cylinder, a sudden opening of the check valve between the cylinder and the tube, and a very sudden end to the flow of oil into the cylinder, accompanied by a very sudden closure of the check valve which allow oil flow into the cylinder. The abrupt cessation of oil flow into the cylinder produces a sudden pressure surge outside the cylinder as the oil tries to enter the cylinder, and this pressure surge thereafter passes outwardly from the oil surrounding the cylinder into the channels feeding the well.

Improved pumping units which can provide smooth controllable pumping action and avoid the tendency to snap sucker rods are needed. Improved smooth pumping units would also be capable of providing the desired pumping action with a fraction of the motor horsepower required in prior art equivalent units. Controllable pumping actions avoid producing current surges in the electrical power lines when an electric motor is employed as the prime mover. This greatly reduces the peak demand of the pumping unit and multiple field units, with additional savings in electrical power costs.

Various other attempts to meet these problems have been proposed by so called long stroke pumping units utilizing velocity control and improved drive for imparting reciprocating movement to the polished rod of the pump. Improvement concepts describe reliable reciprocating drive wherein a dwell period is provided between an upstroke and a downstroke during which the power source is in an off position. A velocity control senses the velocity of the polished rod during the aforementioned dwell period and energizes the pump source when a predetermined velocity is achieved following reversal of direction. However, problems continue with long stroke pumping systems through failures because of problems with their reversing mechanisms resulting in continuing rod breakage and down time.

None of the pumping units in use presently utilize a pumping unit with dynamic fluid ballast for balancing the sucker rod load through a dynamic rotating, shifting ballast mounted on the beam to balance the critical rod, fluid column load. The advantage of such an arrangement, such as in the invention to be described hereinafter, includes lowering the torque and horsepower requirements of the prime mover for given pumping unit loads. An additional benefit of such rotating dynamics combined with dynanamic ballast shifting is reduction of the stress in the rod string by minimizing the difference between the peak rod load and the minimum rod load.

It will be appreciated that the disadvantages mentioned above are not confined to oil wells, but may be experienced in other wells, such as deep water wells which draw liquid from stratus surrounding the well and pump the fluid to the surface in substantially the same manner as an oil well. Accordingly, there is a need for a method and apparatus for pumping a fluid from a well which will avoid the disadvantages of conventional rocker arm pumping units and non beam-pumping units. The present invention provides such a method and apparatus and is useful in wells of all depths.

SUMMARY OF THE INVENTION

One object of the invention is providing an apparatus comprised of a pumping unit for operating a well pump having a rod string which is reciprocated from an upper most position. The apparatus having a base, a support structure mounted on the base, a member mounted on the support structure for pivotal movement about an axis and means connected to the member for pivoting said member between the two positions. Means are also mounted on the member and connected to the rod string in such a manner that the rod string is in its upper most position when the member is in one of the positions and is in its lower most position when the member is in the other position. A counter weight mounted on the member for movement with said member is provided, wherein the counter weight is positioned relative to the axis so that the force of gravity acting on the counter weight applies a greater torque to the member when the rod string is in its upper most position than is applied when the rod swing is in its lower most position.

Another object of this invention is to provide a pumping unit having a dynamic fluid ballast, the pumping unit including a base, a tower pivotally mounted on the base, a horizontal locking bar, and an adjustably pivotable ballast/moment arm actuated by a prime mover driving a flywheel wherein the arm is attached to the circumference of the wheel; and an internal ballast tank located in that portion of the ballast/moment arm which is closer to the tower. The internal ballast tank is partially filled with fluid which provides required lifting force and to offset downward rod string load. The fluid shifts in the ballast tank during rotation of the ballast/moment arm with the ballast/moment arm rotating ninety degrees from horizontal to vertical, reversing and rotating ninety degrees from vertical to horizontal.

In still another object of this invention is a method and apparatus for controlling smooth pumping action by providing and promoting constant drive inertia delivering the constant inertia drive to a ballast/moment arm through a cam functioning arm connecting a fly wheel and the ballast/moment arm, cycling the ballast/moment arm through horizontal to vertical, vertical to horizontal positioning thus shifting fluid ballast in combination with pulley and belt means.

In another object, the invention is concerned with controlling and shifting a fluid ballast from a neutral-horizontal pumping unit position to a maximum ballast load when the pumping unit is in a vertical position and returning the pumping unit back to horizontal.

In yet another object of the invention is a method and apparatus for creating greater than one to one up to two to one or three to one load advantages of the pumping unit through pulley and belting means thus, creating flexibility in stroke length requirements and stroke frequency.

The function of this pumping unit with dynamic fluid ballast is to provide a smooth mechanical motion to pump deep oil well fluids. The pumping unit raises and lowers the rod string of a conventional oil well through a combination of the mechanics of simple equipment. Pulleys and lever arms provide basic components for utilizing the dynamic fluid movement of the invention. Use of a dynamic fluid ballast removes the need for heavy static counterweight balances and also provides a smoothness of motion unachievable by static counterbalances. The tower can be moved from being directly over the well bore while in normal pumping operations, to a pull back position that allows a workover unit clear working space. Mechanical adjustments, such as length of stroke and strokes per minute, can be achieved with minimal effort while at ground level.

The pumping unit with dynamic fluid ballast in accordance with the invention provides a counterweight through fluid dynamics in a tank which has its center of gravity moved toward and away from the pivot axis of a ballast/moment arm as the ballast/moment arm is reciprocated. The weight of the fluid applies a maximum torque to resist the lowering of the rod string and generating a lift which starts the rod string in an upward motion. The torque applied helps in raising the rod string; however, this torque drops to a minimum as the rod string approaches its uppermost position thus assisting in the cessation of the upward motion of the rod string and begins a smooth reversal of motion as the rod string is started back downhole. The ballast/moment arm operates through action of the cam arm driven by the fly wheel powered by the prime mover.

The pumping unit with dynamic fluid ballast for operating a well pump having a rod string which is reciprocated between uppermost and lowermost positions is formed of a base, a support structure mounted on the base, and a member mounted on the support structure for pivotal movement about an axis. Means are provided for connecting to the ballast/moment arm for pivoting the arm between two positions. Further means mounted on the ballast/moment arm are connected to the cam arm in such a manner so that the cam arm is in its uppermost position when the ballast moment arm is in one of said two positions, and is in its lowermost position when the ballast moment arm is in the other position.

The method and apparatus, according to the present invention for pumping fluid from a well, uses a conventional pump approach wherein the pump is disposed near the bottom of the well and conventional sucker rods forms the mechanical lift element. The sucker rods are lifted by a lifting means incorporated within the pumping unit at the top of the well. However, in the present invention, both the upward and downward strokes of the sucker rods are not controlled by the connection between a crank and a rotable arm, but instead the sucker rods are allowed to descend against the resistance under the gravitational force acting on the sucker rods so that at the beginning of the downward stroke of the sucker rods is dependent on the gravitational force. That is, the gravitational force acting on the sucker rods after due allowance is made for the dynamic fluid ballast shifts of the pumping unit. As the sucker rods descend, their resistance is progressively increased so that during the latter portion of the downward stroke of the sucker rods there is applied to the sucker rods an upwardly directed force greater than the gravitational force acting thereon causing a reduction in the rate of descent of the sucker rods before the sucker rods reach the end of the downward stroke. In continuing the cycle, the upwardly directed force applied to the sucker rods is progressively increased as the sucker rods begin their upward stroke. Movement of the sucker rods to completion of the downward stroke through the actions of the pumping unit dynamic fluid ballast commences the movement of the sucker rods through their upward stroke without imposing a substantial pulse loading on the sucker rods. Similarly, the invention provides for shock absorption at the end of the upward stroke of the sucker rods by progressively decreasing the upward directed force applied to the sucker rods by lifting means as the sucker rods end their upward stroke from a force sufficient to lift the sucker rods and the column of fluid in the well to a force which permits the sucker rods to begin their downward stroke. Thereby commencing the movement of the sucker rods through their downward stroke without imposing again substantial pulse loading or unloading of the sucker rods.

Further novel features and objects of this invention will become apparent from the following description, discussion and the appended claims taken in conjunction with the accompanying drawings.

BRIEF DESCRIPTION OF THE DRAWINGS

A preferred structural embodiment of this invention is disclosed in the accompanying drawings in which.

DETAILED DESCRIPTION OF THE INVENTION

Figure 1:
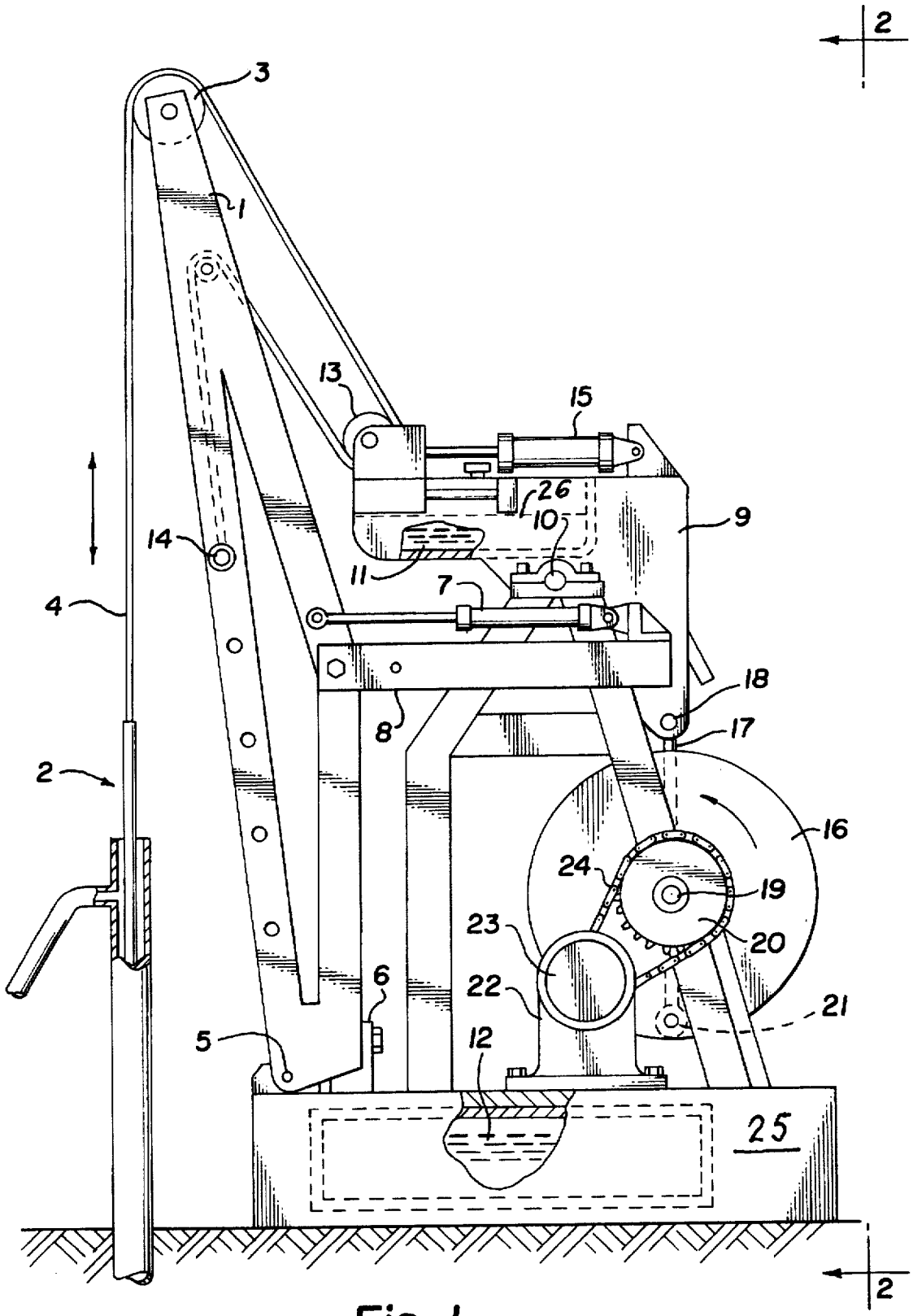
FIG. 1 is a side elevational view of the pumping unit positioned for allowing the rod to be at the lowest pump cycle position.
Figure 2:
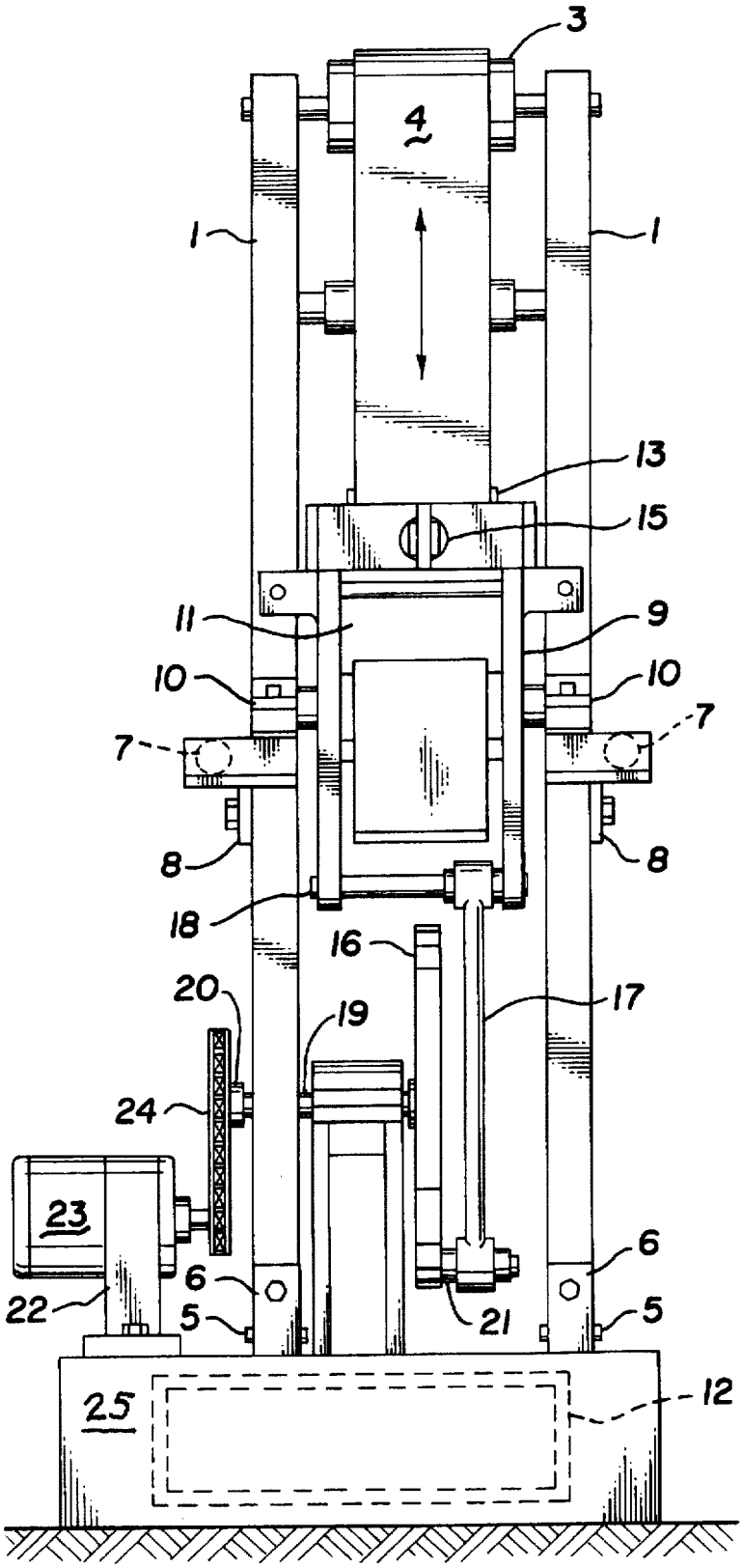
FIG. 2 is a rear elevational view of the pumping unit taken along lines 2—2 of FIG. 1.

Referring now to the drawings by reference character, and in particular in FIG. 1 thereof, an improved oil pumping unit is illustrated. The pumping unit utilizing dynamic fluid ballast for smoothing sucker rod loading during upward and downward reverse cycle directions is presented where tower 1; a ballast/moment arm 9; a rotating flywheel 16 and cam arm (pitman rod) rod 17 present the main components of the pumping unit. The tower 1 supports the total weight of the rod string 2 and fluid load during normal pumping operations. The tower 1 supports a roller 3 and belting 4 which is attached to the rod string 2. The tower 1 can be moved forward and backward on pivot points 5 located at its base. Such tower motion capabilities allows for maximum clearance during workover operations of downhole equipment. Tower 1 acts as a single unit although several components make up its construction. When either in the extended working position or in the vertical maintenance position, tower 1 can be bolted and securely locked. When tower 1 is in the extended working position, a wedge 6 is installed under the base legs. Wedge 6 is bolted to the base of the unit for stability. When tower 1 is in the vertical maintenance position, hydraulic cylinders 7 on each side of the tower 1 will maintain said position. A horizontal locking bar 8 provides a fail safe lock in either position. Movement of the tower 1 is achieved by double action hydraulic cylinders 7. These hydraulic cylinders can be operated manually or with electrical pumps.

The roller 3 located on top of the tower 1 allows the belting 4 vertical access to the rod string 2. All roller bearings are internally oil lubricated and are capable of maximum load ratings required by the pumping unit.

The ballast/moment arm 9 is positioned on a pivot bearing 10. The ballast/moment arm 9 is a multi-functional piece of equipment wherein it rotates ninety degrees from horizontal to vertical in the upstroke of the rod string 2, reverses, and then rotates ninety degrees from vertical to horizontal in the downstroke of rod string 2. From the pivot point forward is the location of the internal fluid ballast tank 11. Ballast fluid volumes can be changed and will vary proportionally with the depth and rod size of each well. The ballast fluid can be removed from the ballast tank and drained into a holding tank 12 located in the horizontal base 25 of the pumping unit. This fluid can be pumped back into the ballast tank with the use of an electric motor and pump. When filled with the appropriate amount of fluid, i.e. allowing the fluid to shift within the tank, the ballast tank provides the required force to lift the rod string 2 and displace fluid load when coupled with the belting 4 and action of the pulleys. The pulleys and belting 4 create at least a one to one load reduction.

A pulley 13 is located on top of the ballast/moment arm 9 and acts as a second pulley for the belting 4. This pulley 13 can be moved along the top of the ballast/moment arm 9 in a top plane direction of the ballast/moment arm 9. Moving the pulley 13 away from the pivot point 10 allows for an increased pump stroke length. Moving the pulley 13 toward the pivot point 10 decreases pump stroke length. Changes in stroke length also requires adjustment in the belt fasteners 14 located on each side of the tower base legs. Increased stroke length is achieved by moving the belt fasteners 14 up the tower leg and decreased stroke length is achieved in the reverse. Movement of the pulley 13 is achieved through the action of a double action hydraulic cylinder 15.

The ballast/moment arm 9 is attached to a rotating flywheel 16 through a cam arm (pitman rod) 17 and pivot bearings 18. The rotating flywheel 16 provides a continuous motion for the pumping unit. The rotating flywheel shaft operates inside the pumping unit substructure, inside bearing housing 19. Fitted to this shaft is a bull gear sprocket and brakes 20 which can be electrical or mechanical. The connecting rod 17 is attached to a pivot bearing located on the outer circumference edge 21 of the rotating flywheel 16. A speed reducing gear unit 22 is operated by a prime mover 23. Vinyl belting, chain 24, or the like can be used at power transfer points. Beltings, bearings, hydraulic cylinders, gears, electrical motors and brakes can be utilized in the inventive pumping unit with dynamic fluid ballast capabilities, all of which are commercially available.

In one embodiment of the present invention, the flywheel 16 has an eight foot diameter and the cam arm 17 has a length of eight feet which allows the pumping unit to displace about twenty feet of rod, which today in a seven to eight thousand foot well requires approximately one hundred horsepower. Average displacement of rod is approximately twelve feet which today requires approximately sixty horsepower utilizing prior art pumping units. Due to the interconnecting action of the flywheel, ballast/moment arm, belt-pulleys and shifting fluid ballast, the pumping unit in accordance with the invention will reduce power requirements from about twenty to fifty percent depending upon conditions of use, well depth, fluid characteristics, sizing of the pumping unit components and the like.

Figure 3:
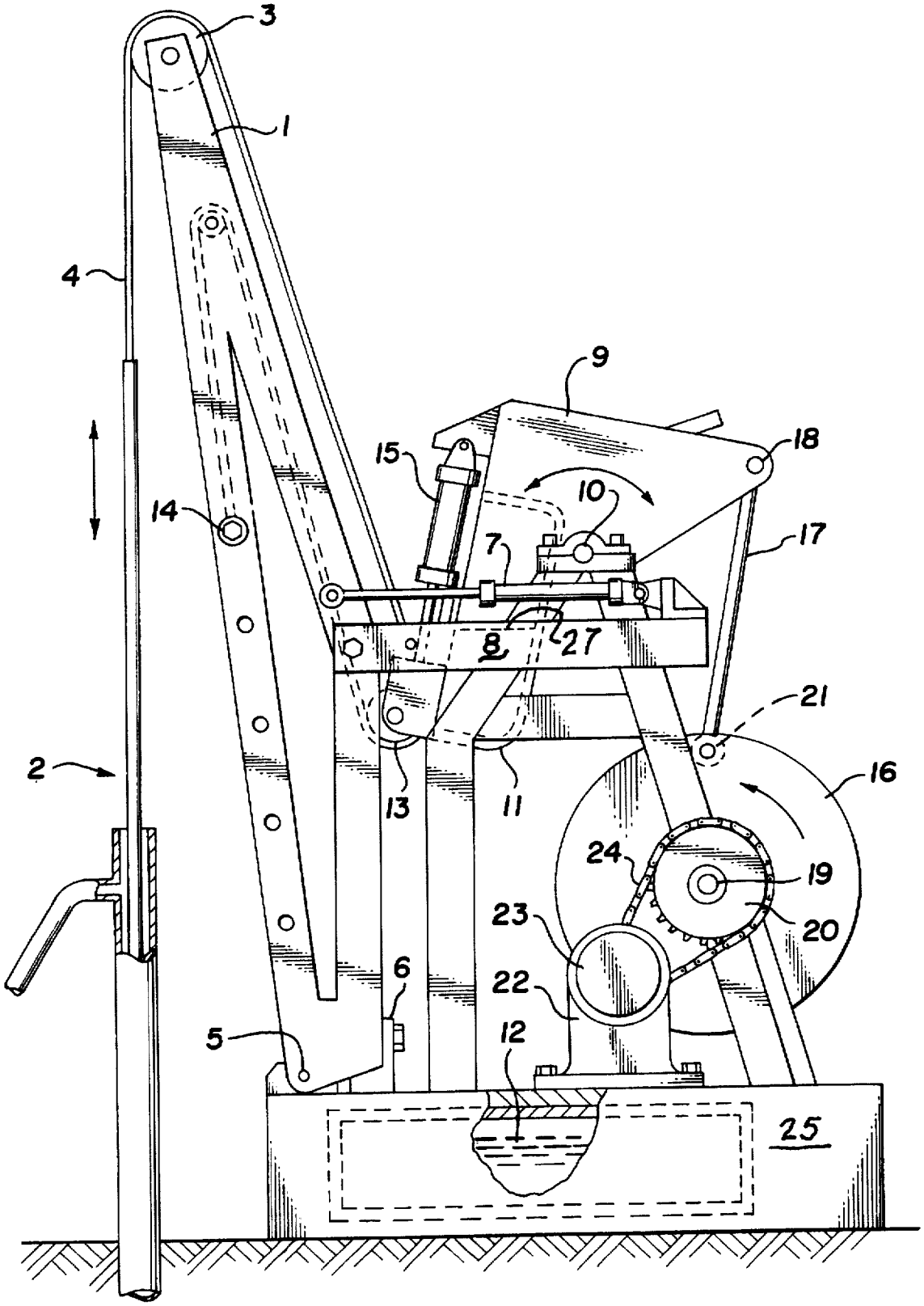
FIG. 3 is a side elevational view of the pumping unit similar to FIG. 1 showing the rod approaching maximum elevated pump cycle position.

In this embodiment, the ballast/moment arm 9 has the configuration of an isosceles 90° top angle triangle with two equal sides when focusing on the pivot bearing 10. In general, the flywheel 16 has a diameter approximately equal to the vertical triangular side of the ballast/moment arm 9. The cam arm 17 is also approximately equal to these preceding dimensions, i.e. about eight feet, which promotes in combination the rotation requirement of the ballast/moment arm 9 in raising the rod string 2 to its upper position. The pumping unit in accordance with the invention provides as closely as possible constant load on the pumping unit mechanism which is achieved by cooperation of the pumping unit component dynamics and the shifting of the fluid ballast 11. In FIGS. 1 and 3 the fluid level in tank 11 is shown by level 26 and level 27, respectively. These accomplishments are achieved even though total directional change of the rod string 2 is required twice during each cycle. Such smooth motion and near constant velocity provides less stress on the rods and the pumping unit components, and substantially reduces rod breakage common with many commercially available pumping units. Fine tuning of the pumping unit addressing stroke length can be adjusted by actions of double action hydraulic cylinders 15 which modify the pumping unit ballast/moment arm 9 stroke length.

The present inventive pumping unit with dynamic fluid ballast 11 provides balancing of loads on the prime mover 23 while avoiding large shock loading on sucker rods 2 and the oil producing formation through a combination of physical mechanics and dynamics. Constant drive inertia is provided through a prime mover 23 power means to the rotating fly wheel 16 and delivery of said inertia drive to the ballast moment arm 9 through cam arm 17. By providing constant drive inertia to the rotating fly wheel 16 through prime mover 23 and chain or belting 24, the pumping unit with dynamic fluid ballast presents a smoothness of operation caused of the counter balancing of the shifting dynamic fluid ballast 11 to that of the rod string load coupled with simple belting and pulley means. The combination not only provides an environment for power reduction as a result of smoothness of operation which avoids breakage of sucker rods, gear boxes and the destabilization of the oil producing formation. The belting and pulley arrangements also afford greater adaptation as to load advantages or reductions of the pumping unit greater than one to one up to three to one through belt and pulley manipulations of the pumping unit.

In the embodiment wherein the rotating flywheel 16 and cam arm 17 have approximately equal dimensions ie. about eight feet, the ballast tank 11 has a volume of about 53 cubic feet or greater and can hold approximately 3,000 pounds or more of shifting fluid ballast. The dimension of the ballast tank 11 is from about eight to about eight and half feet long but the width and depth dimensions of the ballast tank 11 can be designed proportionally depending on the load requirements of the application i.e. sucker rod characteristics, well depth, viscosity of the fluids being pumped and the like. Sizing of the present invention is easily adapted to the requirements of downhole load pump cycle requirements or frequency of cyclings as well as stroke length. These adjustments can be easily made within a very wide range of a set physical sizing of the apparatus through adjustments of the belt fastener 14 positions on the tower leg which in combination with the physical length adjustments of pulley 13 and the amount of liquid ballast or tank size accommodating the liquid or fluid ballast. Substantial flexibility of the pumping unit in accordance with the present invention can be made without changing significant element dimensions such as the rotating flywheel 16, ballast moment arm 9, tower 1 and the like.

Commercially available belting may be employed for use as the belting 4 in the pumping unit. Belting materials are available in various thicknesses and widths and have ultimate tensile strength at rupture of 3,500 pounds per inch and greater. Other belts of increasing thicknesses have ultimate tensile strength rupture up to 9,000 pounds per inch. Thus, depending upon the load requirements, well bore depth and the like, appropriate belting can be found to fulfill the needs for wear and load stress requirements of the present invention.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

What is claimed is:

1. A pumping unit for operating a well pump having a rod string which is reciprocated from an uppermost position to a lowermost position, comprising:

a. a horizontal base at ground level;

b. a pumping unit support structure securely mounted on the base;

c. a member mounted on the support structure for pivotal movement about on axis;

d. means connected to the member for pivoting said member between two positions;

e. means mounted on the member and connected to the rod string in such a manner that the rod string is in its uppermost position when the member is in one of said positions and is in its lowermost position when the member is in the other position; and f. a counterweight in the form of a tank for holding a constant fluid volume, said tank being so positioned that the fluid center of gravity located in the center of the tank moves toward and away from said axis as said member is pivoted mounted on the member for movement with said member, said counterweight being so positioned relative to said axis that the force of gravity acting on the counterweight applies a greater torque to the member when the rod string is in its lowermost position than is applied when the rod string is in its uppermost position; the counterweight mounted on the member of applying a variable torque to the member to pivot said member, being so positioned relative to said axis that the torque applied to the member by the counterweight resists movement of the rod string in one direction and assists movement of the rod string in the other direction the variable torque resists said movement increasing as the rod string approaches the end of its travel in said one direction and the torque which assists movement decreasing as the rod string approaches the end of its travel in the other direction.

2. The apparatus of claim 1 wherein the member is comprised of a ballast/moment arm of an isosceles triangle configuration connection connected at a first triangular base point to a drive means and connected at a second triangular base point to a pulley engaged with a belting means which is connected to a rod string through a roller mounted on a support structure tower allowing the belt to suspend directly over the rod string.

3. The apparatus according to claim 1 wherein the support structure mounted on the horizontal base supports a rod string through belting means over a roller supported by a tower means, the tower means being pivotally mounted on the base and movable to a position which is away from the vertical position over the rod string allowing for unobstructive access to a well-head.

4. The apparatus according to claim 1 wherein the means connected to the member for pivoting said member between two positions has a prime mover and connected to the rotating flywheel by continuous loop drive means.

5. The apparatus of claim 1 wherein the member is comprised of a ballast/moment arm of an isosceles triangle configuration connected at a first triangular base point to a drive means and connected at a second triangular base point to a pulley mounted on a support structure tower allowing the belt to suspend directly over the rod string.

6. The apparatus according to claim 1 wherein the support structure mounted on the base supports a rod string through belting means over a roller supported by a tower means, the tower means being pivotally mounted on the base and moveable to a position which is away from the vertical position over the rod string.

7. The apparatus according to claim 1 wherein the means connected to the member for pivoting said member between two positions has a prime mover connected to the rotating flywheel by continuous loop drive means.

8. A pumping unit for operating a well pump having a rod string which is reciprocated from an uppermost position to a lowermost position, comprising:

a. a horizontal base at ground level, b. a pumping unit support structure securely mounted on the base, c. a member mounted on the support structure for pivotal movement about an axis, the member comprised of a ballast/moment arm of an isosceles triangle configuration connected at a first triangular base point to a drive means and connected at a second triangular base point to a pulley engaged with a belting means which is connected to a rod string through a roller mounted on a support structure tower allowing the belt to suspend directly over the rod string, d. means connected to the member for pivoting said member between two positions, e. means mounted on the member and connected to the rod string in such a manner that the rod string is in its uppermost position when the member is in one of said positions and is in its lowermost position when the member is in the other position, and f. a counterweight in the form of a tank for holding a liquid, said tank being so positioned that the liquid center of gravity located in the center of the tank moves toward and away from said axis as said member is pivoted, the counterweight mounted on the member for movement with said member, said counterweight being so positioned relative to said axis that the force of gravity acting on the counterweight applies a greater torque to the member when the rod string is in its lowermost position than is applied when the rod string is in its uppermost position.

9. The apparatus of claim 8 wherein the drive means is comprised of a prime mover communicating with a rotating flywheel through drive means, said rotating flywheel connected to the ballast/moment arm through a pitman rod, the pitman rod communicating with the flywheel on the circumference of the flywheel and with the first triangular base point of the ballast/moment arm.

10. The apparatus according to claim 9 wherein the belting means, pulley and roller, are connected to the rod string for reciprocating the rod string between the two positions through pivotal movement of the ballast/moment arm provides at least a one to one load reduction on the pumping unit.

11. A unit for operating a well pump having a rod string which is reciprocated between uppermost and lowermost positions, comprising:

a. a horizontal base at ground level, b. a pumping unit support structure securely mounted on the base, c. a member mounted on the support structure for pivotal movement about an axis, the member comprised of a ballast/moment arm of an isosceles triangle configuration connected at a first triangular base point to a drive means and connected at a second triangular base point to a pulley engaged with a belting means which is connected to a rod string through a pulley mounted on a support structure tower allowing the belt to suspend directly over the rod string, d. means connected to the member for pivoting the member between two positions, e. means mounted on the member and connected to the rod string in such a manner that the rod string is in its uppermost position when the member is in one of said positions and is in its lowermost position when the member is in the other position, and f. a counterweight in the form of a tank for holding a liquid, said tank being so positioned that the center of gravity of the liquid moves toward and away from said axis as said member is pivoted, the counterweight mounted on the member for applying a variable torque to the member to pivot said member, said member being so positioned relative to said axis that the torque applied to the member by the counterweight resists movement of the rod string in one direction and assists movement of the rod string in the other direction, with the variable torque which resists said movement increasing as the rod string approaches the end of its travel in said one direction and the torque which assists movement decreasing as the rod string approaches the end of its travel in the other direction.

12. The apparatus of claim 11 wherein the drive means is comprised of a prime mover communicating with a rotating flywheel through drive means, said rotating flywheel connected to the ballast/moment arm through a pitman rod, the pitman rod communicating with the flywheel on the circumference of the flywheel and with the first triangular base point of the ballast/moment arm.

13. The apparatus according to claim 12 wherein the belting means, pulley and roller, are connected to the rod string for reciprocating the rod string between the two positions through pivotal movement of the ballast/moment arm provides at least a one to one load reduction on the pumping unit.

* * * * *